US010422490B2

(12) United States Patent
Tong et al.

(10) Patent No.: US 10,422,490 B2
(45) Date of Patent: Sep. 24, 2019

(54) BANNER LIGHTS SYSTEMS AND METHODS

(71) Applicant: Polygroup Macau Limited (BVI), Tortola (VG)

(72) Inventors: Ricky Tong, Shenzhen (CN); Chi Yin Alan Leung, Apleichau (HK)

(73) Assignee: Polygroup Macau Limited (BVI), Tortola (VG)

( * ) Notice: Subject to any disclaimer, the term of this patent is extended or adjusted under 35 U.S.C. 154(b) by 351 days.

(21) Appl. No.: 15/391,334

(22) Filed: Dec. 27, 2016

(65) Prior Publication Data

US 2017/0191626 A1 Jul. 6, 2017

Related U.S. Application Data

(60) Provisional application No. 62/272,823, filed on Dec. 30, 2015.

(51) Int. Cl.

| | |
|---|---|
| ***F21S 4/10*** | (2016.01) |
| ***F21V 21/008*** | (2006.01) |
| ***F21V 23/02*** | (2006.01) |
| ***F21V 23/06*** | (2006.01) |
| ***H05B 33/08*** | (2006.01) |
| ***F21S 4/15*** | (2016.01) |
| ***F21Y 113/10*** | (2016.01) |
| ***F21W 121/00*** | (2006.01) |
| ***F21W 121/04*** | (2006.01) |
| ***F21Y 115/10*** | (2016.01) |

(52) U.S. Cl.

CPC . *F21S 4/10* (2016.01); *F21S 4/15* (2016.01); *F21V 21/008* (2013.01); *F21V 23/02* (2013.01); *F21V 23/06* (2013.01); *H05B 33/08* (2013.01); *F21W 2121/00* (2013.01); *F21W 2121/04* (2013.01); *F21Y 2113/10* (2016.08); *F21Y 2115/10* (2016.08)

(58) Field of Classification Search

CPC .. F21S 4/10; F21S 4/15; F21V 21/008; F21V 23/02; F21V 23/06; H05B 33/08

USPC ..... 362/231

See application file for complete search history.

(56) References Cited

U.S. PATENT DOCUMENTS

| | | | | |
|---|---|---|---|---|
| 6,210,016 | B1 * | 4/2001 | Prineppi | F21V 19/04 362/123 |
| 6,267,486 | B1 * | 7/2001 | Tai | F21V 21/088 362/249.01 |
| 2002/0036908 | A1 * | 3/2002 | Pederson | B60Q 1/2611 362/545 |
| 2007/0195527 | A1 * | 8/2007 | Russell | F21S 8/06 362/240 |
| 2009/0161359 | A1 * | 6/2009 | Siemiet | F21S 4/28 362/235 |
| 2011/0122625 | A1 * | 5/2011 | Carone | F21V 17/007 362/249.14 |

(Continued)

*Primary Examiner* — Bryon T Gyllstrom

(74) *Attorney, Agent, or Firm* — Troutman Sanders LLP; Ryan A. Schneider; Christopher C. Close, Jr.

(57) ABSTRACT

Aspects of the disclosed technology include a banner lighting system for providing decorative lighting. The banner lighting system comprises a plurality of light groups each having a plurality of segments. Each segment hangs to provide a decorative arrangement having the appearance of a banner. The segments of the light groups can be arranged electrically in series while the light groups can be arranged electrically in parallel.

20 Claims, 2 Drawing Sheets

(56) References Cited

U.S. PATENT DOCUMENTS

2013/0329444 A1* 12/2013 Oh ..... F21V 21/00
362/543

* cited by examiner

BANNER LIGHTS SYSTEMS AND METHODS

CROSS-REFERENCE TO RELATED APPLICATIONS

This application claims priority to and the benefit under 35 U.S.C. § 119(e) of U.S. Provisional Patent Application Ser. No. 62/272,823, filed on 30 Dec. 2015, entitled "Banner Lights Systems and Methods," the contents of which are hereby incorporated by reference in their entirety as if fully set forth below.

TECHNICAL FIELD

Aspects of the present disclosure relate to a light display, and, more particularly, for banner lights for providing a festive holiday light display.

BACKGROUND

Light strings are commonly used to provide decorative lighting. Typically, light strings are made of an electric wire having a plurality of serially connected lighting elements. As such, a typical light string may be conveniently wrapped around three-dimensional objects, such as, for example, a Christmas tree.

Such light strings may not be desirable, however, for use in decorating a two-dimensional area, such as a wall or ceiling, because a typical light string may be difficult to affix or may appear aesthetically unpleasing. Thus, it would be desirable to develop an improved lighting system for easily decorating two-dimensional areas.

BRIEF DESCRIPTION OF THE FIGURES

Reference will now be made to the accompanying figures, which are not necessarily drawn to scale, and wherein.

DETAILED DESCRIPTION

Figure 1:
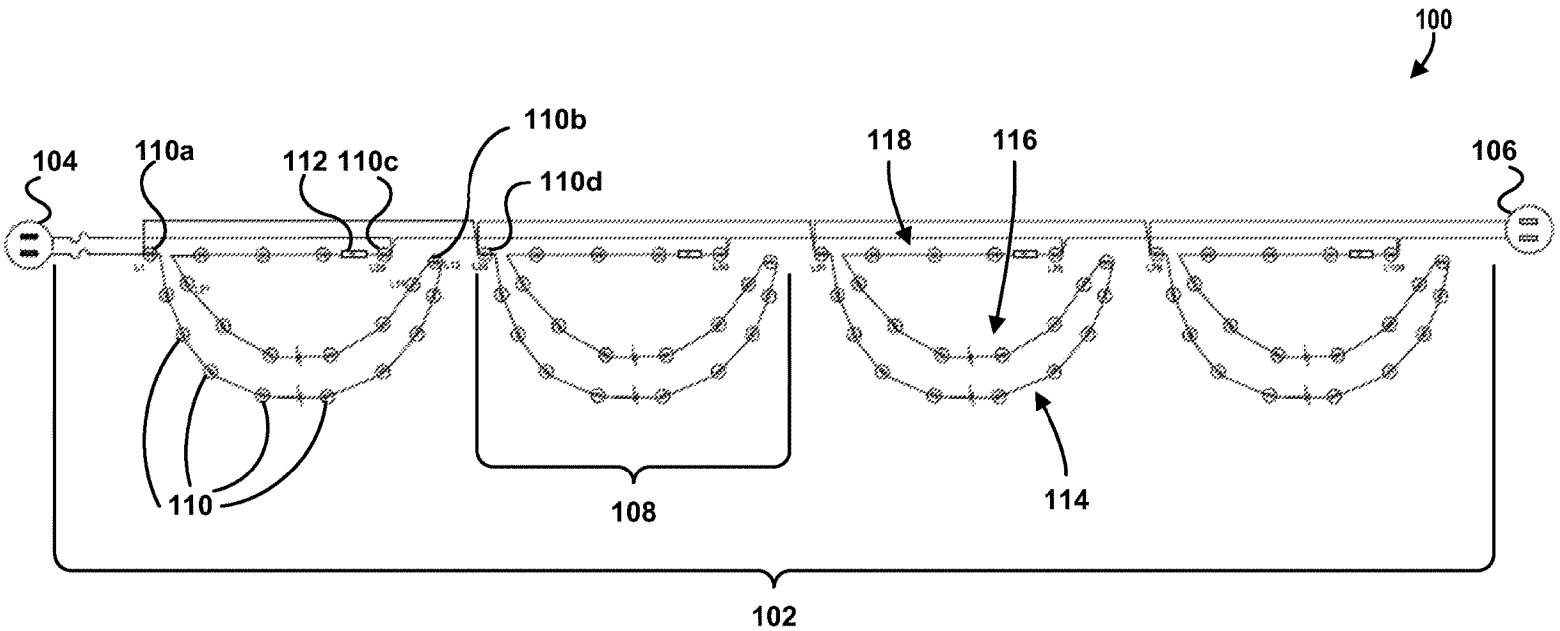
FIG. 1 is a diagram of banner lights, in accordance with an example embodiment of the presently disclosed subject matter.

The present disclosure can be understood more readily by reference to the following detailed description of exemplary embodiments and the examples included herein. Before the exemplary embodiments of the devices and methods according to the present disclosure are disclosed and described, it is to be understood that embodiments are not limited to those described within this disclosure. Numerous modifications and variations therein will be apparent to those skilled in the art and remain within the scope of the disclosure. It is also to be understood that the terminology used herein is for the purpose of describing specific embodiments only and is not intended to be limiting. Some embodiments of the disclosed technology will be described more fully hereinafter with reference to the accompanying drawings. This disclosed technology may, however, be embodied in many different forms and should not be construed as limited to the embodiments set forth therein.

In the following description, numerous specific details are set forth. However, it is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Unless otherwise noted, the terms used herein are to be understood according to conventional usage by those of ordinary skill in the relevant art. In addition to any definitions of terms provided below, it is to be understood that as used in the specification and in the claims, "a" or "an" can mean one or more, depending upon the context in which it is used. Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

Also, in describing the exemplary embodiments, terminology will be resorted to for the sake of clarity. It is intended that each term contemplates its broadest meaning as understood by those skilled in the art and includes all technical equivalents that operate in a similar manner to accomplish a similar purpose.

To facilitate an understanding of the principles and features of the embodiments of the present disclosure, exemplary embodiments are explained hereinafter with reference to their implementation in an illustrative embodiment. Such illustrative embodiments are not, however, intended to be limiting.

The materials described hereinafter as making up the various elements of the embodiments of the present disclosure are intended to be illustrative and not restrictive. Many suitable materials that would perform the same or a similar function as the materials described herein are intended to be embraced within the scope of the exemplary embodiments. Such other materials not described herein can include, but are not limited to, materials that are developed after the time of the development of the invention, for example.

Embodiments of the disclosed technology include banner lights for providing a festive lighting fixture. In various embodiments, banner lights may be suspended from a support structure, such as a horizontal beam, overhang, ceiling, or wall. In some embodiments, banner lights can be suspended such that a portion of the plurality of lighting elements comprising the banner lights may hang from, or dangle below, the support structure to create the appearance that the lighting elements are suspended in air.

Referring now to the drawings, FIG. 1 illustrates an example embodiment of banner lights 100. According to some embodiments, banner lights 100 can include a light string 102 having a first plug 104 on a first end and a second plug 106 on a second end. A light string 102 may include one or more electrical conductors, such as wires, configured to provide power to lighting elements. According to some embodiments, a first plug 104 can be a male plug and a second plug 106 can be a female plug. A first plug 104 can be configured to plug into a standard wall socket to enable the flow of electricity through the banner lights 100. For example, in some embodiments, a first plug 104 may be configured to plug into a standard 120V wall socket. As will be understood by those of skill in the art, in various embodiments a first plug 104 may have different configurations (e.g., two-pronged or three-pronged) and may serve to connect the banner lights 100 to different sources of power having different voltages. According to some embodiments, the second plug 106 can be configured to receive a plug from another set of banner lights 100 or other light string. Thus, according to some embodiments, the second plug 106 of a first set of banner lights 100 may connect to a first plug 104 of a second set of banner lights 100 such that the two sets of banner lights 100 can be connected in series. Accordingly, in some embodiments, a plurality of banner lights 100 can be connected in a daisy-chain fashion to create a continuous string of banner lights 100.

According to some embodiments, a light string 102 of the banner lights 100 may include one or more electrical conductors. For example, a light string may include two or three conductors that span from the first plug 104 to the second plug 106. According to some embodiments, the conductors can be wires. In some embodiments, a light string 102 can be, for example, a jacketed and twisted copper wire.

In some embodiments, a light string 102 may include one or more light groups 108. According to some embodiments, each light group 108 may include a plurality of lighting elements 110. According to some embodiments, a lighting element 110 can include one or more incandescent bulbs, LEDs, or any other suitable light sources. The lighting elements 110 may produce light having one or more colors. As will be understood by those having skill in the art, a light group 108 can be made up of virtually any number of lighting elements 110. For example, in some embodiments, a light group 108 can have 25 or 50 lighting elements 110. In some embodiments, a light group 108 can be made up of 50 incandescent bulbs. In some embodiments, a light group 108 can be made up of between 25-36 LED lamps. In some embodiments, each light group 108 in a light string 102 may be of a different configuration from the others.

In some embodiments, one or more light groups 108 can include a resistor pack 112. A resistor pack 112 can be used to provide electrical resistance that may change the voltage or current that is provided to a light group 108. According to some embodiments, a resistor pack 112 can be used in conjunction with a light group 108 having lighting elements 110 that are LED lamps. The amount of resistance provided by the resistor pack 112 can vary in different embodiments. For embodiments where the lighting elements 110 of a light group 108 are incandescent bulbs, a resistor pack 112 may not be necessary to include in the light group 108.

In some embodiments, a resistor pack 112 can be attached in series or in parallel according to the desired total resistance. A resistor pack 112 can include resistors of varying ratings according to the desired power dissipation sought in a particular embodiment. The resistor can be fixed or variable, or a combination thereof. A fixed resistor could be, for example, a carbon composition, carbon pile, carbon film, printed carbon resistor, thick film, thin film, metal film, metal oxide film, wire wound, foil, ammeter shunt, grid resistor, or comprise cermet, Phenol formaldehyde resin, tantalum, or water. A variable resistor could be, for example, an adjustable resistor, potentiometer, or decade box.

In some embodiments, the voltage or current changed by the resistor pack 112, or otherwise changed, can be based on a desired voltage or current. This can be advantageous since changing the voltage or current can avoid problems associated with non-desired voltages and currents. For example, a non-desired voltage and/or current can lead to damage to the circuit and/or its components. This damage, or a non-desired voltage and/or current generally, can lead to serious problems including, but not limited to, fire hazards, manufacturing delays and cost increases, and an increased replacement rate for consumers. This can additionally lead to dissatisfaction with the product by its users.

According to some embodiments of the present disclosure, each light group 108 in the light string 102 can be in parallel with the other light groups 108. For example, in one embodiment, a light string 102 can have four light groups 108, each light group having lighting elements 110 that are LED lamps, wherein the four light groups 108 can be attached to the light string 102 in parallel.

FIG. 1 shows a circuit diagram of an example embodiment of banner lights 100 having four light groups 108 attached to a light string 102 in parallel. As shown in FIG. 1, according to some embodiments, a first lighting element 110*a* of the lighting elements 110 may be connected to three conductors (e.g., wires), or wires. For example, a first lighting element 110*a* may be connected to a conductor from the first plug 104, a conductor leading a first light group 108, and a conductor leading to a lighting element 110*d* that is the first lighting element of a second light group 108, wherein the first light group 108 and second light group 108 are connected in parallel.

In some embodiments, the lighting elements 110 of each light group 108 may be connected in series. According to some embodiments, the lighting elements 110 of each light group 108 may further be connected in series with a resistor pack 112, as discussed above. In some embodiments, some lighting elements 110 within a particular light group 108 can be arranged in parallel with respect to other lighting elements 110 within that light group. According to some embodiments, various light groups 108 can be connected to a light string 102 in both series and in parallel. For example, in some embodiments, a light string 102 can have two pairs of light groups 108, wherein each pair includes two light groups 108 connected in series, and each pair of two light groups 108 connected in series can be attached to the light string in parallel with respect to the other pair of light groups 108. In another embodiment, a light string 102 can have three pairs of light groups 108, wherein each pair includes two light groups 108 connected in series, and each of the three pairs of light groups 108 connected in series can be attached to the light string in parallel with the other two pairs of light groups 108.

In some embodiments the lighting elements 110 and/or the light groups 108 are connected in parallel to reduce the number of lighting elements that lose power in the event of a circuit break (e.g., a burnt out light bulb or blown fuse). In some embodiments the lighting elements 110 and/or the light groups 108 are connected in series to reduce the complexity of manufacture.

Figure 2:
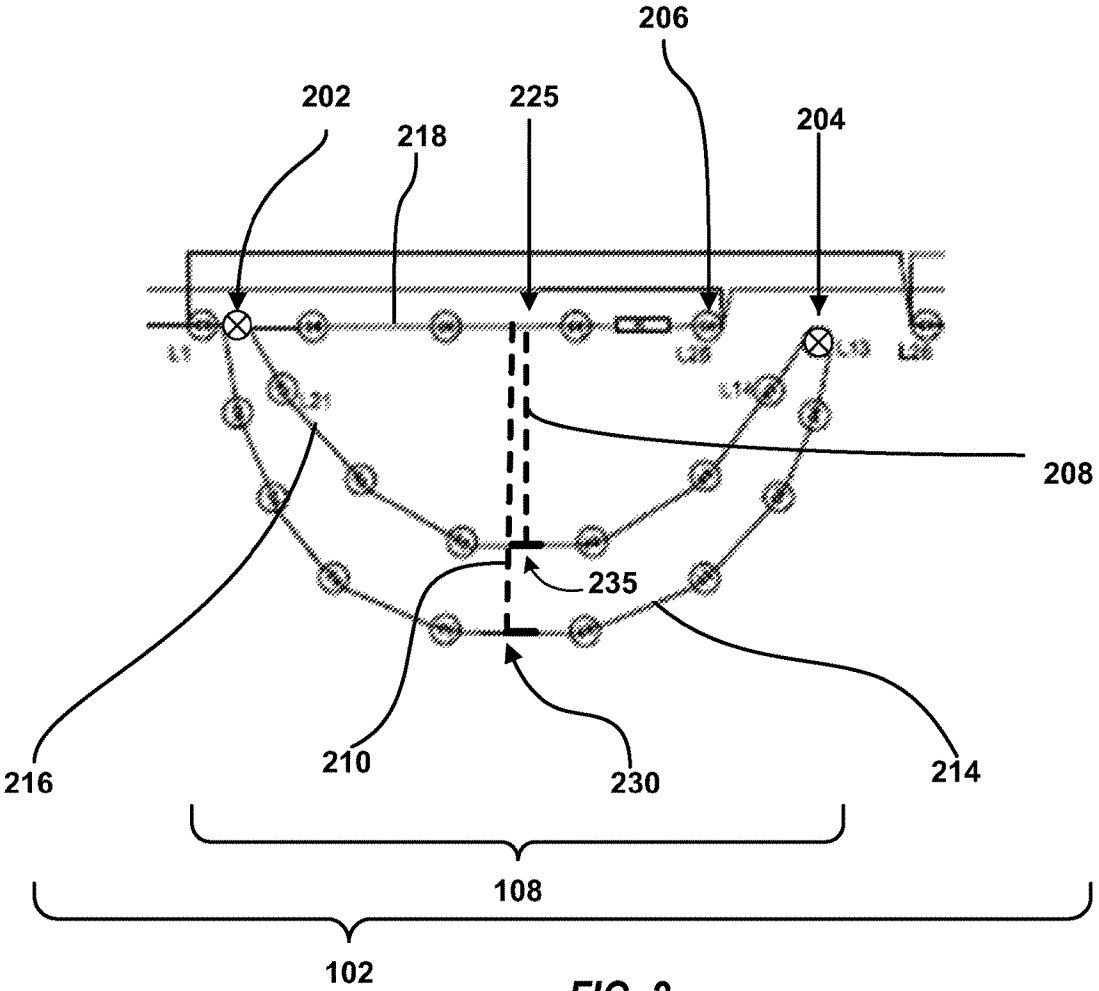
FIG. 2 is a diagram of banner lights, in accordance with an example embodiment of the presently disclosed subject matter.

According to embodiments of banner lights 100, one or more light groups 108 can be configured in a "banner configuration." Generally, a banner configuration can include a plurality of light strands (or, alternatively, "segments") that hang in a semi-circular orientation below an approximately horizontally orientated top strand. In some embodiments, as shown in FIGS. 1 and 2, each successive light strand or segment may form a larger semi-circle than the one above it. In some embodiments, each light strand or segment may provide a different color of lights. According to some embodiments, as shown in FIG. 1, a light group 108 disposed in a banner configuration may include a top strand 118 of lighting elements 110, a middle strand 116 of lighting elements 110, and a bottom strand 114 of lighting elements 110. Each strand 114, 116, 118 may include a number of lighting elements 110 and a portion of wiring that connects the lighting elements 110.

According to some embodiments, as shown in FIG. 1, the top strand 118 can be attached to a support structure such that the lighting elements 110 of the top strand 118 can be disposed in a substantially straight, horizontal line. In some embodiments, the middle strand 116 can be configured to hang below the top strand 118 such that the lighting elements 110 of the middle strand 116 may hang in an approximately semi-circular shape. In some embodiments, the bottom strand 114 can be configured to hang below the middle strand 116 such that the lighting elements 110 of the bottom strand 114 may hang in an approximately semi-circular shape.

According to some embodiments, as shown in FIG. 1, the top, middle, and bottom strands 118, 116, 114 can be formed from a continuous length of wiring in a light group 108, by bending (i.e., changing the direction of) and securing portions of the wiring at two attachment points. In some embodiments, the ends of each strand 114, 116, 118 can converge at each attachment point. In some embodiments, one or more portions of the wiring of the light group 108 can be attached to either a support structure or another portion of the wiring of the light group 108 at each attachment point by an attachment means. For example, an attachment means may include, but is not limited to, a tie, a zip-tie, a cable tie, a string, a pin, an adhesive, a clamp, a clip, band, or any other such suitable means. In some embodiments a top strand 118 may have a resistor pack 112 and/or one or more lighting elements 110 attached to it.

According to some embodiments, the top, middle and bottom strands can be formed from a non-continuous length of wiring to form a light group 108. For example, by hanging separate strands attached in parallel, with each successive strand hanging below the strand or segment above it.

FIG. 2 shows a circuit diagram of an example embodiment of a light group 108 composed of three segments 214, 216, and 218 connected in series. The three segments 214, 216, and 218, while connected in series, can comprise a light group 108 that can be connected in parallel to other light groups 108, as illustrated in FIG. 1. As shown in FIG. 2, according to some embodiments, a first segment 214 can be attached to a first attachment point 202 and hang in a semi-circular orientation, connecting at a second location to a second attachment point 204. As show in FIG. 2, in some embodiments, the first attachment point 202 can be at a left-most location of a light group 108, and the second attachment point 204 can be at a right-most location of a light group 108. Thus, for example, a banner configuration may be formed between a first lighting element 110*a* and a second lighting element 110*b* (as shown in FIG. 1).

In some embodiments, as shown in FIG. 2, the second attachment point 204 can demarcate the beginning of the second segment 216 such that the second segment 216 is connected to the second attachment point 204 and connected in series with the first segment 214. According to some embodiments, the second segment 216 can hang in a semi-circular orientation, connecting at a second location to the first attachment point 202 so that it substantially abuts the first attachment point of the first segment 214. This first attachment point 202 can demarcate the beginning of the third segment 218 connected in series to the second segment 216. The third segment 218 can be attached at a second location to a third attachment point 206. In some embodiments, the third attachment point 206 can act as a physical support to maintain the shape of the third segment 218. In additional embodiments, the third attachment point 206 can act as a junction between the third segment 218 and the light string 102, connecting the light group 108 in parallel. In yet another embodiment the third attachment point 206 can act as both the physical support and the junction point. In some embodiments, as illustrated in FIG. 2, the third segment 218 can be substantially horizontal. In some embodiments, one or more portions of the wiring of the light group 108 can be attached to either a support structure or another portion of the wiring of the light group 108 at each attachment point by an attachment member. For example, an attachment member may include, but is not limited to, a tie, a zip-tie, a cable tie, a string, a pin, an adhesive, a clamp, a clip, band, or any other such suitable member. In some embodiments the third segment 218 may have a resistor pack 112 and/or one or more lighting elements 110 attached to it.

In some embodiments, as shown in FIG. 2, the three segments 214, 216, and 218 of a light group 108 can be configured in a banner display. As shown in FIG. 2, the first segment 214 can hang in a semi-circular orientation having a radius 210 measured from a center 225 of the third segment 218 to a lowest-hanging point 230 of the first segment 214. As shown in FIG. 2, the second segment 216 can hang in a semi-circular orientation having a radius 208 measured from a center 225 of the third segment 218 to a lowest-hanging point 235 of the second segment 216. In some embodiments, the radius 210 of the first segment 214 can be larger than the radius 208 of the second segment 216, so that the segments can form the appearance of a tiered banner lighting system and, in some embodiments, the appearance of being suspended in air.

In some embodiments, each of the three segments 214, 216, and 218 can be configured to provide a different color of light. For example and not limitation, in some embodiments, the first strand 214 may have red lights, the second strand 216 may have white lights, and the third strand 218 may have blue lights, or vice versa. According to embodiments of the present disclosure, any combination of different colored lighting elements may be present in the banner lights 100.

Although the light groups 108 of the banner lights 100 have been described herein with reference to three strands or segments (e.g., 114, 116, and 118, or 214, 216, and 218), it should be understood that a light group 108 may be configured to have any number of strands or segments. Furthermore, embodiments of a light group 108 may have more than two attachment points, such that different designs of banner configurations may be utilized. For example, in some embodiments, there may be one or more attachment points on a middle strand 116 to which the bottom strand 118 attached, such that the bottom strand 118 may be positioned as two generally semi-circular strands. One of skill in the art will recognize than may variations of a banner lights 100 design are possible by utilizing different numbers of strands and attachment points, as well as different locations of attachment points.

As described above, in some embodiments, an embodiment of banner lights 100 may have a plurality of successive light groups 108 that can be arranged in the banner configuration. Further, as described above, a plurality of banner lights 100 may be connected together in series to form a long light display. Further, because the middle and bottom strands 116, 118 of the banner lights 100 can hang from the top strand 114, the banner lights can create an enhanced decorative effect by creating the impression that the lights are suspended in air.

While certain embodiments of the disclosed technology have been described in connection with what is presently considered to be the most practical embodiments, it is to be understood that the disclosed technology is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain embodiments of the disclosed technology, including the best mode, and also to enable any person skilled in the art to practice certain embodiments of the disclosed technology, including making and using any devices or systems and performing any incorporated methods. The patentable scope of certain embodiments of the disclosed technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A banner lighting system comprising:

an electrical conductor having a first end and a second end; and one or more light groups, each light group comprising:

a plurality of lighting elements; and a plurality of segments formed from a continuous length of the electrical conductor, wherein (i) a first end of a first segment connects to a first attachment point and a second end of the first segment connects to a second attachment point, (ii) a first end of a second segment connects to the second attachment point and abuts the second end of the first segment and a second end of the second segment connects to the first attachment point, and (iii) a first end of a third segment connects to the first attachment point and a second end of the third segment connects to a third attachment point, the third attachment point disposed between the first and second attachment points.

2. The banner lighting system of claim 1, wherein the first and second segments hang in a semi-circular orientation, and a first radius measured from a center of the third segment to a lowest-hanging point of the first segment is greater than a second radius measured from the center of the third segment to a lowest-hanging point of the second segment.

3. The banner lighting system of claim 1, wherein the third segment is arranged substantially horizontally.

4. The banner lighting system of claim 1, wherein the plurality of segments are secured at the respective attachment points using a connector selected from the group comprising zip-tie, cable tie, string, pin, adhesive, clamp, slip, and band.

5. The banner lighting system of claim 1, wherein each of the first, second, and third segments provides a different color of light.

6. The banner lighting system of claim 1, wherein the electrical conductor is a jacketed copper wire.

7. The banner lighting system of claim 1 further comprising:

a first male plug is configured to plug into a standard 120V wall socket; and a second female plug configured to receive a male plug of a second lighting system.

8. The banner lighting system of claim 1, wherein each lighting element in the plurality of lighting elements is selected from the group comprising incandescent bulb and LED lamp.

9. The banner lighting system of claim 1, wherein each lighting element in the plurality of lighting elements comprises colored light of red, yellow, blue, or any combination thereof.

10. The banner lighting system of claim 1, wherein each group in the plurality of light groups further comprises a resistor pack for changing voltage and/or current.

11. The banner lighting system of claim 1, wherein the plurality of light groups are connected in parallel.

12. The banner lighting system of claim 1, wherein the plurality of light groups are connected in series.

13. The banner lighting system of claim 1, wherein the banner lighting system comprises a first, second, third, and fourth light groups, the first light group and the second light group connected in series and comprising a first light group pair, and the third light group and the fourth light group connected in series and comprising a second light group pair, and the first and second light group pairs connected in parallel.

14. The banner lighting system of claim 1, wherein the banner lighting system comprises at least two light group pairs, each of the light group pairs comprising two light groups connected in series, and each of the two light group pairs connected in parallel.

15. The banner lighting system of claim 1, wherein the banner lighting system comprises four light groups, each of the light groups connected in parallel.

16. A banner lighting system comprising:

an electrical conductor having a first end and a second end; and one or more light groups, each light group comprising:

a plurality of lighting elements; and first, second, and third segments, wherein the segments are arranged in a banner configuration by (i) hanging the second segment in a semi-circular orientation beneath the first segment and (ii) hanging the third segment in a semi-circular orientation such that a first radius measured from the center of the first segment to a lowest-hanging point of the third segment is greater than a second radius measured from the center of the first segment to a lowest-hanging point of the second segment.

17. The banner lighting system of claim 16, wherein the first segment is oriented substantially horizontally.

18. The banner lighting system of claim 16, wherein each of the segments are connected in parallel.

19. The banner lighting system of claim 16, wherein each of the first, second, and third segments provides a different color of light.

20. The banner lighting system of claim 16, wherein each light group in the one or more light groups further comprises a resistor pack for changing voltage and/or current.

* * * * *